US009555932B2

(12) United States Patent
Tseng et al.

(10) Patent No.: US 9,555,932 B2
(45) Date of Patent: Jan. 31, 2017

(54) PLASTIC LINER BAG WITH DRAWSTRING

(71) Applicant: INTEPLAST GROUP, LTD., Livingston, NJ (US)

(72) Inventors: Ben Tseng, East Brunswick, NJ (US); Leo Yih Lang Chang, Livingston, NJ (US); Kelvin Yang, Madison, NJ (US); Jyh-yao Raphael Li, Parsippany, NJ (US)

(73) Assignee: Interplast Group Corporation, Livingston, NJ (US)

( * ) Notice: Subject to any disclaimer, the term of this patent is extended or adjusted under 35 U.S.C. 154(b) by 0 days.

(21) Appl. No.: 14/727,206

(22) Filed: Jun. 1, 2015

(65) Prior Publication Data

US 2015/0344190 A1 Dec. 3, 2015

Related U.S. Application Data

(60) Provisional application No. 62/005,100, filed on May 30, 2014.

(51) Int. Cl.

*B65D 33/28* (2006.01)
*B65D 33/16* (2006.01)
*B65F 1/00* (2006.01)

(52) U.S. Cl.

CPC ..... *B65D 33/28* (2013.01); *B65D 33/165* (2013.01); *B65F 1/002* (2013.01); *Y10T 24/15* (2015.01)

(58) Field of Classification Search

CPC ..... B65D 33/28; B65D 33/165
USPC ..... 383/75
See application file for complete search history.

(56) References Cited

U.S. PATENT DOCUMENTS 3,738,567 A * 6/1973 Ruda ..... B65D 33/28 206/554
4,047,997 A * 9/1977 Sudo ..... B29C 47/0023 156/229
4,442,147 A * 4/1984 Schirmer ..... B29C 47/0023 138/140
4,475,971 A * 10/1984 Canterino ..... B32B 27/08 156/163
4,762,430 A * 8/1988 Bullard ..... B65D 33/28 383/75
5,006,380 A * 4/1991 Fraser ..... B32B 27/32 383/72
5,133,607 A 7/1992 Bonke
7,520,673 B2 4/2009 Bonke
7,758,243 B2 7/2010 Bonke
(Continued)

*Primary Examiner* — Jes F Pascua
(74) *Attorney, Agent, or Firm* — Senniger Powers LLP

(57) ABSTRACT

A plastic can liner and a drawstring for closing the can liner. First and second plastic panels joined along edges of the panels define a bag body. Opposed first and second panel edges that are not joined define a can liner opening. A first hem extends along the first panel edge and a second hem extends along the second panel edge. A drawstring extends through the first and second hems. The drawstring is a cross-laminated plastic film. In some embodiments, the drawstring includes first and second drawstring strips sealed together adjacent the opposite ends thereof. Each of the first and second drawstring strips can be made from a plastic film including a first layer and a second layer bonded to the first layer. Each of the first and second layers have a machine direction oriented transverse to the length of the drawstring and the machine direction of the other layer.

19 Claims, 7 Drawing Sheets

(56) References Cited

U.S. PATENT DOCUMENTS

| | | | | |
|---|---|---|---|---|
| 8,167,490 | B2 | 5/2012 | Hu et al. | |
| 8,523,439 | B2 | 9/2013 | Ross | |
| 8,657,495 | B2 * | 2/2014 | Maxwell | B65D 33/28 383/53 |
| 2009/0317650 | A1 * | 12/2009 | Yang | B32B 27/08 428/523 |
| 2010/0046860 | A1 * | 2/2010 | Kent | B65F 1/0006 383/75 |
| 2010/0111452 | A1 | 5/2010 | Ross | |
| 2010/0303388 | A1 * | 12/2010 | Kent | B31B 19/18 383/32 |
| 2011/0002559 | A1 * | 1/2011 | Wood | B65D 33/28 383/75 |
| 2011/0229061 | A1 * | 9/2011 | Bertrand | B65D 33/28 383/75 |
| 2014/0334749 | A1 * | 11/2014 | Borchardt | B65D 33/00 383/109 |

* cited by examiner

PLASTIC LINER BAG WITH DRAWSTRING

REFERENCE TO RELATED APPLICATION

This application is a non-provisional application claiming priority to provisional U.S. application 62/005,100, filed May 30, 2014, the entire disclosure of which is expressly incorporated herein by reference.

FIELD OF THE INVENTION

The present invention relates to plastic can liners having a drawstring at the opening of the bag for closing the bag.

BACKGROUND OF THE INVENTION

Plastic liner bags are common today for a variety of applications including storage of dry goods, food storage, and trash collection. It is desirable to be able to close such bags after filling. There are various known closure mechanisms, including drawstring closures as disclosed, for example, in U.S. Pat. No. 5,133,607 and Patent Publication 2010/0111452.

SUMMARY OF THE INVENTION

It is an object of the invention, therefore, to provide an improved drawstring and an improved plastic liner bag with a drawstring.

Briefly, therefore, the invention is directed to a plastic can liner comprising first and second plastic panels joined along edges of the panels, a can liner opening defined by opposed first and second panel edges which are not joined; a first hem along the first panel edge defining the can liner opening and a second hem along the second panel edge defining the can liner opening; and a drawstring running through the first and second hems, wherein the drawstring is a cross-laminated plastic film.

Other objects and features will be in part apparent and in part pointed out hereinafter.

DETAILED DESCRIPTION OF THE EMBODIMENT(S) OF THE INVENTION

Figure 1:
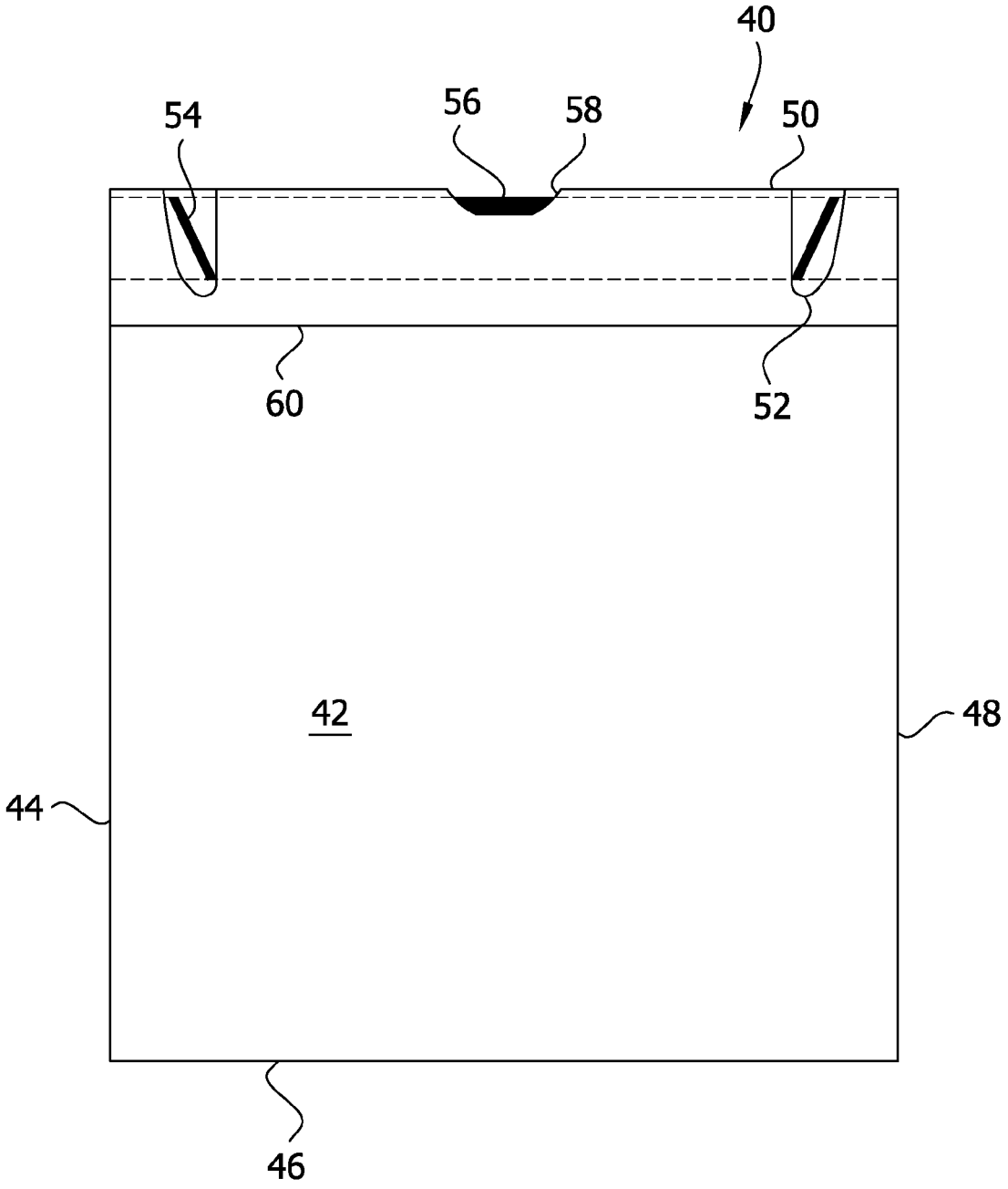
FIG. 1 is a schematic view of the liner of the invention.

A plastic liner of the invention is depicted in FIG. 1 at 40 and has a first panel 42 and a second panel opposite the first panel. The liner 40 is joined along the three edges of the panels at 44, 46, and 48. A can liner opening is defined by opposed first and second panel edges at 50 which are not joined. There is a hem between seal line 60 and top edge 50 where the hem has two hem panels including a first hem panel and a second hem panel. Drawstring 56 is housed within the hem. The drawstring 56 here constitutes, essentially, two drawstring strips which are sealed together at seal line 54 to form a continuous loop. The seal line 54 seals together the first and second hem panels on the front of the bag 40, the drawstring strips, and the first and second hem panels on the back of the bag. The drawstring 56 is accessible through notch 58 in the hem.

Figure 7:
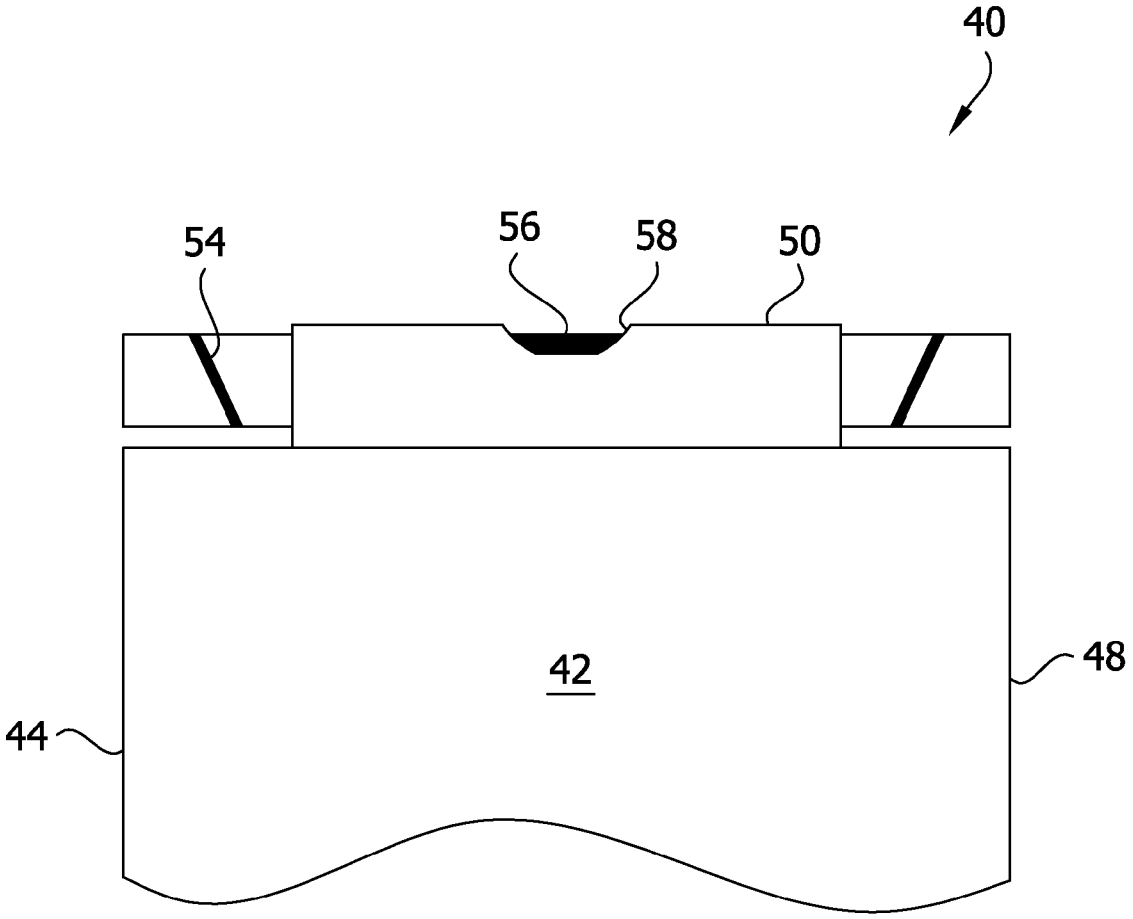
FIG. 7 is a schematic view of another liner of the invention.

In the preferred embodiment shown, the seal lines 54 seal the first panel 42, two drawstring strips, and second panel together to fix the drawstring in position before use. The first panel 42 and second panel are not elastic whereas the drawstrings 56 are elastic. The hem has perforations or score lines (broadly, a tear line) illustrated at 52. When the elastic drawstring 56 is stretched to mount on a container, the panels limit the extension of the drawstring. Upon this stretching, the perforations 52 allow the hem to separate along the perforations so the non-elastic panels do not limit the stretching of the elastic drawstring 56. These perforations are not required in all embodiments, such as in the embodiment illustrated in FIG. 7 where the drawstring strips are sealed together, not sealed to the hem, and there is an opening in the hem for the sealed ends of the drawstring 56.

In one preferred embodiment, the sealing lines 54 are optionally slanted as shown so the mouth is wider at the top of the drawstring 56 and narrower at the bottom of the drawstring. With this configuration, there is less stretching at the top of the drawstring 56 when mounting the bag 40 on a container. This enables the user to more easily mount the liner 40 on a container. That is, the wider top of the drawstring 56 easily slips over the upper lip of a container and with less stretching, while the narrower bottom (i.e., shorter bottom edge) of the drawstring 56 still tightly grips the container. This also makes it easier to remove the liner 40 from the container, as the wider top (i.e., longer top edge) of the drawstring 56 easily slides back over the lip of the container. In conventional drawstrings 56, the seal lines 54 are perpendicular to the drawstring length. In one embodiment of the present invention, the seal lines 54 are slanted at least 5°, such as at least 10° or at least 15°, from perpendicular to the drawstring length. One currently preferred embodiment has a slant of between about 10° and about 30°, such as about 20°.

Figure 2:
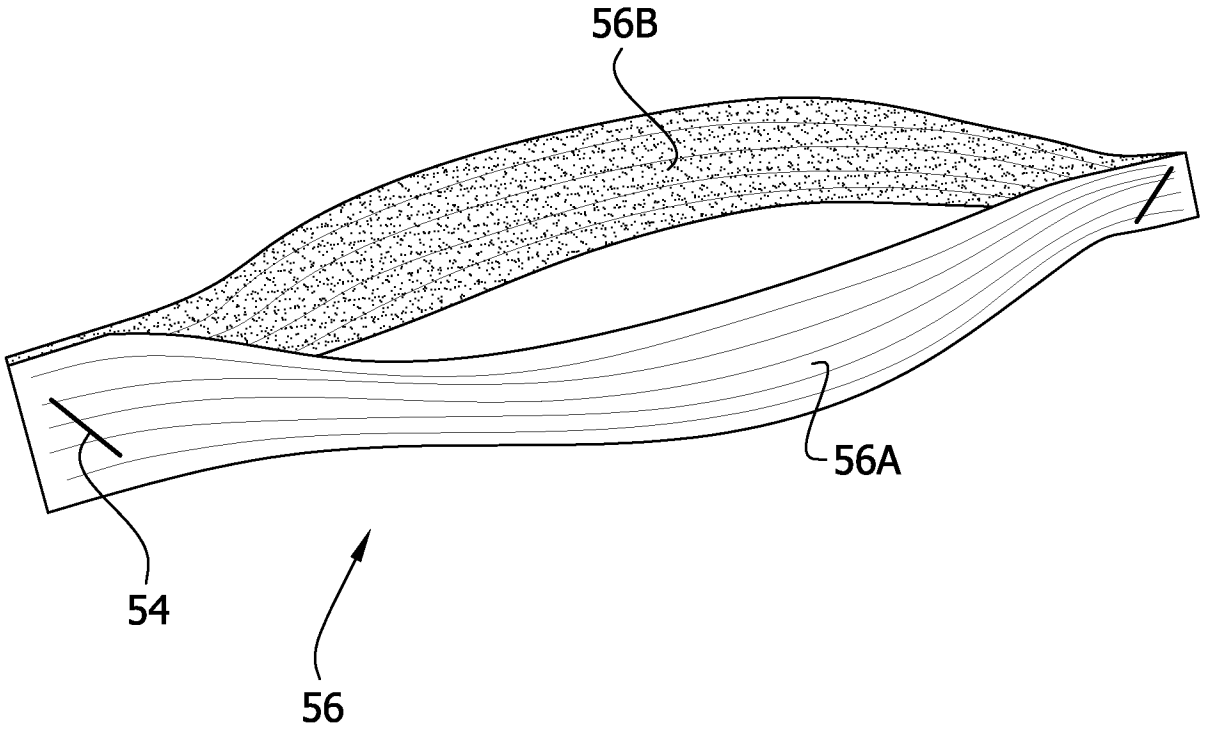
FIG. 2 is a perspective of the drawstring of the invention with stippling covering an interior surface of the drawstring to illustrate a color contrast with an exterior surface of the drawstring.

As illustrated in FIG. 2, in one embodiment the cross-laminated drawstring 56 preferably has a ridged texture with ridges running in the direction parallel to the length of the drawstring. The ridges on the outwardly facing surface 56A of the drawstring 56 are deeper than the ridges on the interior facing surface 56B of the drawstring. This assists in gripping the drawstring 56 for closing. The interior facing surface 56B of the drawstrings 56 has shallower ridges that assist in sealing the two drawstrings. These ridges or grooves are formed as a function of the cross-laminating forming process as discussed below. The drawstring 56 also optionally has its first flat side of one color and its second flat side of another color, as shown in FIG. 2.

Figure 3:
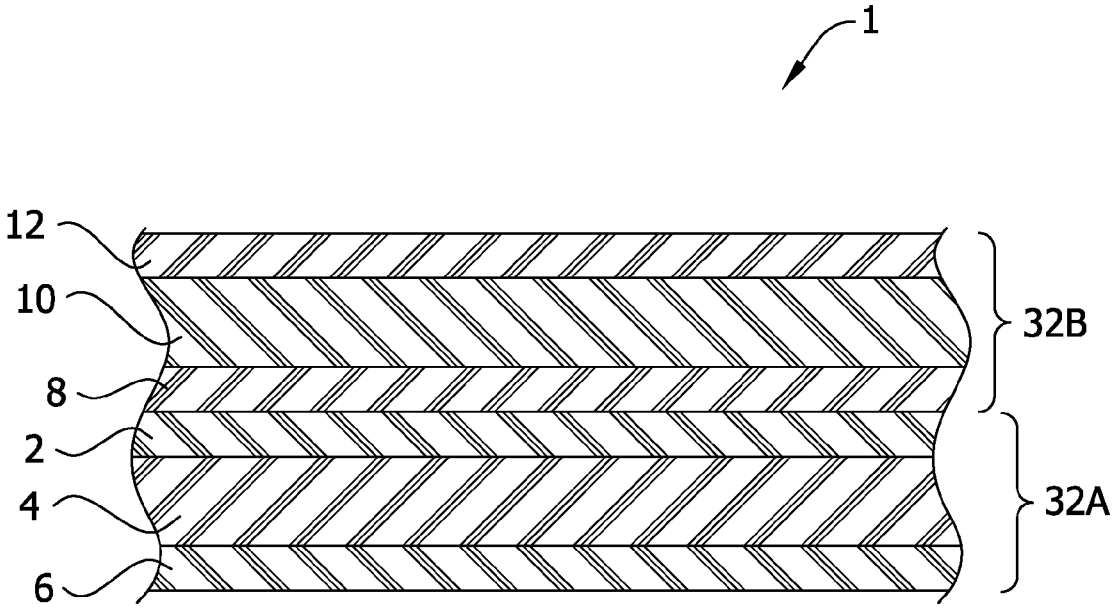
FIG. 3 is a cross-sectional schematic view of a laminated drawstring film of the invention.

As explained above the seal lines 54 seal the first panel 42, two drawstrings 56, and second panel together to fix the drawstrings in position before use. Good sealability and seal strength are required between the two drawstrings 56 and between the drawstrings and panels. Polyethylene of lower density such as LDPE, LLDPE, m-LLDPE, is used to have good sealing properties. However, PE of lower density has weaker mechanical strength, such as tensile strength, and is not suitable for the drawstring application. Accordingly, the cross-laminated film 1 in the present invention has at least two layers, 32A and 32B, as illustrated in FIG. 3. In the illustrated embodiment, each of the layers 32A, 32B is a multiply layer. The exterior plies 12 and 6 contain components that are sealable and the core plies 10 and 4 contain components that provide strength and elasticity. So the overall drawstring film 1 of the present invention has good sealing properties while maintaining good mechanical properties due to the film structure and the unique cross lamination process. The objects of the invention are therefore achieved in view of the cross-laminated, multi-ply nature of the drawstring 56.

The plastic liner panel material is not narrowly critical to the operation of the invention, and may be any of a number of available polymer materials suitable for this purpose. In one currently preferred embodiment, the panel material is high density polyethylene (HDPE) or linear low density polyethylene (LLDPE).

The cross-laminated elastic film 1 which is used for the drawstring 56 is strong, tough, has good tensile and tear strength in the machine direction, has good tensile and tear strength in the transverse direction, and is elastic. The tensile strength in the machine direction (MD) is crucial in this application. When the drawstrings 56 are pulled from notch 58 to close the filled bag 40, the drawstrings require good tensile strength to carry the weight of the filled bag. The tear strengths in both MD and transverse direction (TD) are also important in case that there are nicks on the drawstrings 56. Conventional HDPE drawstrings have very weak tear strength in MD. When there are nicks, the drawstrings can be easily split or torn in the MD. The drawstring 56 of about 60-90 g per square meter (gsm) (weight per unit area, aka, "weight") in the present invention has tensile strength in MD greater than about 10 lbs/inch, Elmendorf tear strength (in both MD and TD) of greater than about 3000 grams and tensile elongation of greater than about 500%.

In its most basic form, each drawstring strip 56 of the invention is formed from a cross-laminated film 1 comprising at least two plies 32A, 32B, which are laminated together with their major directions of orientation at an angle with respect to each other. In the final drawstring 56, therefore, the machine direction of one layer 32A is at an angle with respect to the machine direction of another layer 32B to which it is laminated. This angle is at least about 5° and up to 90°.

In one preferred embodiment, the drawstring film 1 is elastic in that it can be stretched by between about 3% and about 40% in the machine direction, and still snap back to its original dimensions in both directions with strong force at room temperature. No heat treatment is required to assist the film 1 to return to its original dimensions. In elasticity tests, the film 1 is stretched 5% at time=0. Since the film 1 is elastic there is a force that the film would like pull back. The strength, F, at time 0 is, for example F0. The pull-back strength decreases slowly since the plastic film 1 has elastoplasticity properties, the combination elasticity and plasticity. The strength, F, at 2 minutes is, for example F2. In the currently preferred embodiments, F2/F0 is greater than about 50%.

The plastic film 1 is elastic below the yield point. When applied deformation is above the yield point, the film 1 does not snap back to its original, pre-stretched dimensions; i.e., if the drawstrings 56 are stretched beyond the yield point. For drawstring can liner applications of the present invention, the size of the bag 40 is more or less equivalent to the size of the container and the drawstring 56 is intentionally shortened a little so the drawstring can tie the bag to the mouth of the container. The stretching percentage required to fix a liner of the invention to a container is therefore usually not high and is below the yield point.

The cross-laminated drawstring 56 of the invention in one embodiment has a weight of between about 45 and about 500 grams per square meter (gsm), preferably between about 70 and about 200 gsm. In one preferred embodiment, the drawstring material has a weight per unit area (weight) of less than 100 gsm, such as between about 50 to 100 gsm. The nominal thickness of the film 1 is between about 50 and about 550 microns, constituted by two or more layers 32A-32*n*. The film 1 in the currently preferred embodiments is manufactured in continuous lengths.

In one embodiment, each layer 32A, 32B of the drawstring material 1 contains a thermoplastic component and optional additional components. At least one layer 32A, 32B may also contain an elastic component. Examples of suitable thermoplastic components include high-density polyethylene (HDPE), linear low-density polyethylene (LLDPE), low-density polyethylene (LDPE), metallocene linear low density polyethylene (m-LLDPE) and copolymers thereof. Examples of suitable elastic components include elastic polymers (EP) such as that available from Exxon-Mobil under the trade name EXACT, and available from Dow Chemical under the trade name Affinity. These are ethylene-olefin copolymers plastomers which are available in the form of odorless transluscent pellets. The preferred polyethylene components have a density between about 0.8 and about 0.98 g/cm$^3$ and a melt index of between about 0.01 and about 5 g/10 minutes under ASTM D 1238 and condition E. Examples of suitable elastic components include elastic polymers (EP) such as that available from Exxon-Mobil under the trade name EXACT, and available from Dow Chemical under the trade name Affinity. The preferred elastic components have a density between about 0.8 and about 0.92 g/cm$^3$ and a melt index of between about 0.1 and about 10 g/10 minutes under ASTM D 1238 and condition E. Both the thermoplastic components and the elastic components in the currently preferred embodiment are 100% PE based, and completely free of PP or other non-PE-based polymers.

Among the optional additional components are included anti-block, slip, UV inhibitors, colorants, and fillers, and others as are known in the plastic film industry.

In one preferred embodiment of the invention where the drawstring 56 has a first layer 32A and a second layer 32B, the first layer comprises up to about 30 weight % of an elastic component such as between about 2 and 30 weight % of the elastic component, between about 5 and about 30 weight % of the elastic component, or between about 5 and about 15 weight % of the elastic component. In this preferred embodiment, the first layer 32A comprises at least about 65 weight % of the thermoplastic component, such as between about 70 and about 95 weight % of the thermoplastic component, between about 70 and about 90 weight % of the thermoplastic component, or between about 70 and about 85 weight % of the thermoplastic component. The first layer 32A also optionally contains up to about 30 weight % of other additive components such as the color, slip, etc. components described above, for example between about 5 and about 25 weight % of such components. The proportions of the constituents of the second layer 32B are typically distinct from the proportions in the first layer, though the proportions in the second layer also preferably fall within these same ranges. Moreover, the proportions of the constituents of both layers 32A, 32B cumulatively, or all layers if more than two layers are employed, preferably fall within these same ranges.

In one preferred embodiment, the two layers 32A, 32B described above are each three-ply layers. That is, there are three plies within each of the major layers 32A, 32B of material used in forming the drawstring film 1. These plies constitute a core component 4, 10, a sealing component 6, 12, and a laminating component 2, 8 as described in U.S. Pat. No. 4,629,525, and are co-extruded as described in British Pat. 1,526,722, the entire disclosures of which are incorporated by reference.

As shown schematically in FIG. 3 of the present application, in the drawstring film 1 the lamination ply 2 of the first layer 32A and the lamination ply 8 of the second layer 32B are designed to face and contact each other as the first and second layers 32A and 32B are laminated together. The lamination plies 2 and 8 are formulated so that the two layers 32A and 32B can be easily and strongly bond together under pressure. The core plies 4 and 10 are the central ply of each layer 32A, 32B, and provide the strength and the mechanical properties of the film 1. The seal plies 6 and 12, which are the outer plies of the eventual film product 1, are formulated for easy sealing. So in the ultimate laminated drawstring film 1, the bottom ply 6 is the sealing ply 6 of the first layer 32A, on top of that is the core ply 4 of the first layer 32A, on top of that is the laminating ply 2 of the first layer 32A, on top of that is the laminating ply 8 of the second layer 32B, on top of that is the core ply 10 of the second layer 32B, and on top of that is the seal ply 12 of the second layer 32B. As described in column 8 of the '525 patent, the core component or "main layer" exhibits a fibrillar grain structure and exhibits a predominant direction of splittability. The laminating component or "second layer" controls bonding strength between the two films being laminated together. And the sealing component is a "surface layer which facilitates sealing of the laminate."

Figure 4:
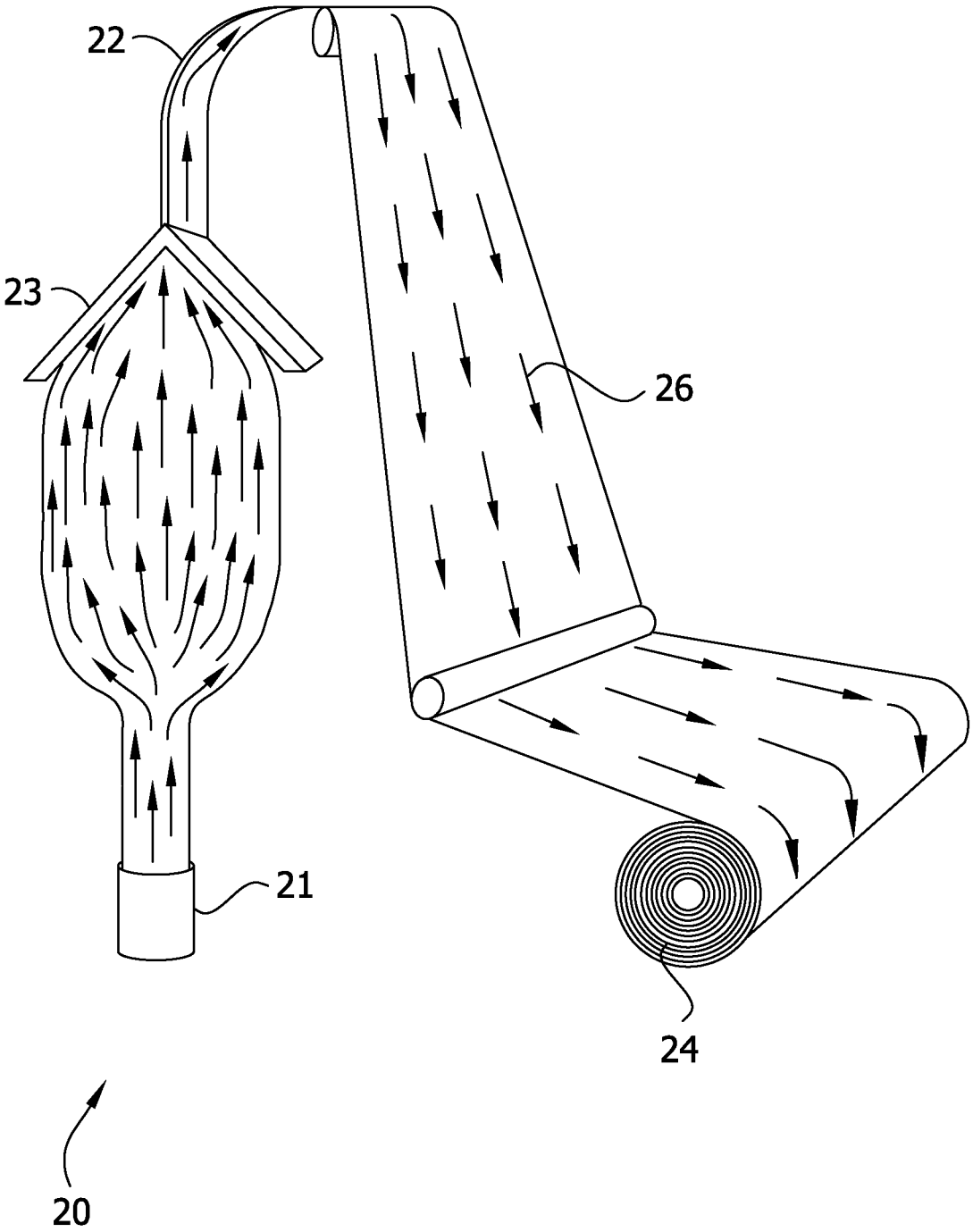
FIGS. 4-6 are schematic views which assist in describing process steps for making the drawstring film of the invention.

As shown schematically in FIG. 4, the three components or plies of each layer 32A, 32B of the drawstring film 1—sealing 6, 12, core 4, 10, and laminating 2, 8—are coextruded through a blown film process 20 to yield a film layer 22 which is further processed to form a layer 32A or layer 32B which will eventually be laminated together. Three extruders within the blown film process 20 extrude the thermoplastic materials with the formulae of seal ply 6, 12, core ply 4, 10, and lamination ply 2, 8 into a co-extrusion die 21. The thermoplastic materials of the three plies are heat-bounded in the co-extrusion die 21 to form a film tube. The film tube is then blown and enlarged into a bigger film tube, which is later collapsed in a tenter 23 and wound into a roll 24. The process is called blown film process 20, which is common in the industry. Co-extrusion of three plies is known, for example, from British Pat. 1,526,722, the entire disclosure of which is incorporated by reference. Film layer 22 exhibits a molecular structure with predominant direction of splittability or major direction of orientation shown by arrows 26. Film layer 22 is gathered onto roll 24.

Figure 5:
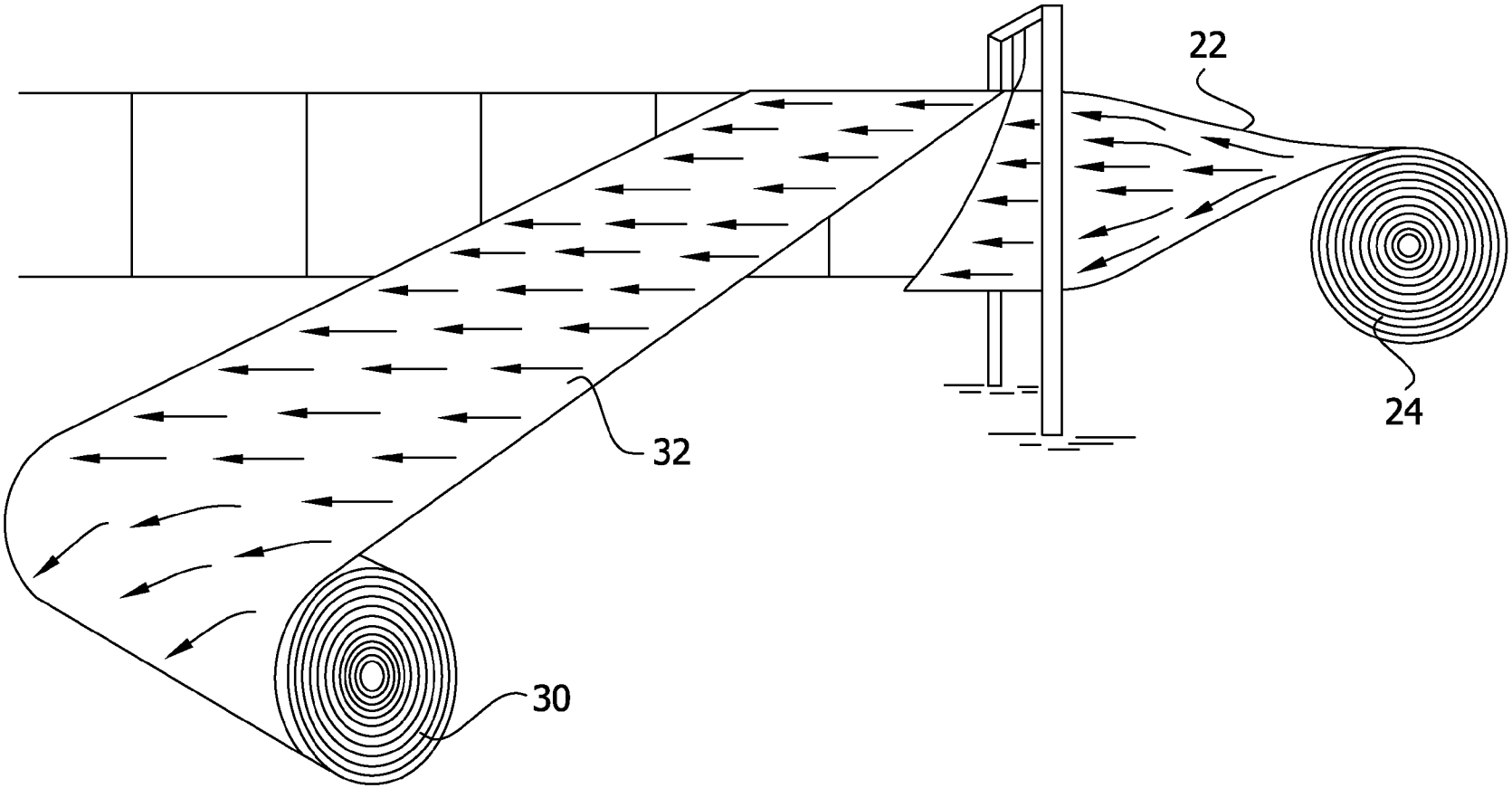

As shown schematically in FIG. 5, layer 22 from roll 24 is processed to yield a film 32 in which the major direction of orientation is re-aligned so that it is at an angle with respect to the machine direction rather than corresponding to the machine direction. The collapsed film tube roll 24 from the blown film process 20 is formed into a tube by a drum. A knife with the desired cutting angle slits the film tube into single-layer film (not tube anymore). The film is wound into film roll 30. This is accomplished in the manner described in the British Pat. 1,526,722; U.S. Pat. No. 4,629,525. This yields roll 30 containing a film corresponding with a respective one of the layers 32A, 32B of the drawstring film 1 and The major direction of orientation of the film layer 32 is at an angle with respect to the length direction of the film. The film is processed as shown in FIG. 5 to yield a film in which the major direction of orientation is at an angle of between about 30 and 60 degrees, such as about 45 degrees, with respect to the length direction of the film.

Figure 6:
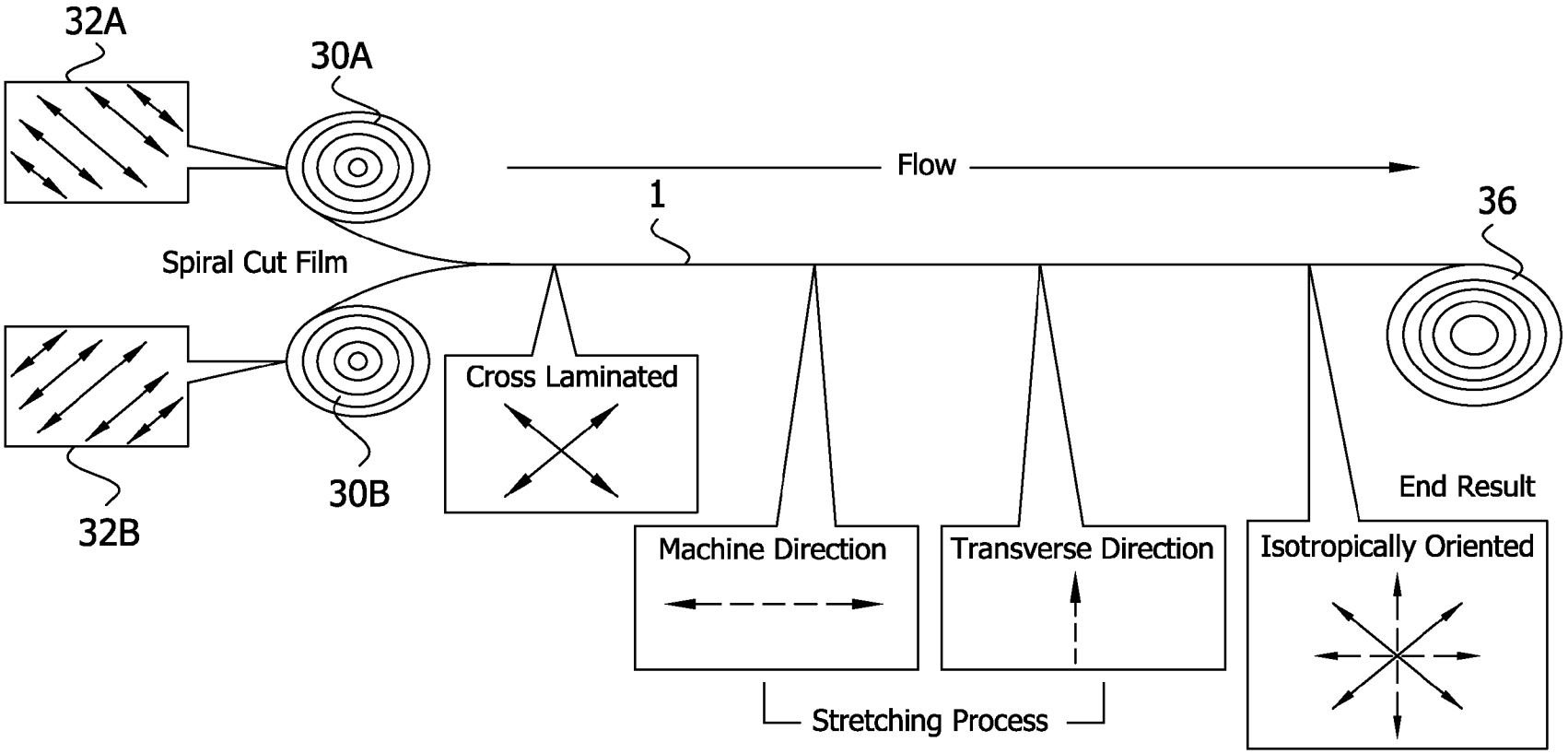

Two film layers 32A and 32B as produced according to FIG. 5 are then laminated together as shown in FIG. 6 to form a laminated film 1 for use in forming the drawstring 56. The major direction of orientation of each of the film layers 32A, 32B as shown in FIG. 6 is at an angle with respect to the length direction of each film layer. These film layers 32A, 32B are then laminated together as shown and as explained in U.S. Pat. Nos. 4,629,525 and 5,626,944, both of which are incorporated by reference and demonstrate what has become the level of skill in the art. The laminated film 1 is stretched as disclosed in these prior patents. At least two film rolls 30A, 30B with opposite cutting angles are laminated together and stretched in both machine and transverse directions with several sets of press rolls to form cross laminated XF film 1. Some sets of the press rolls have grooves, which stretch the XF film in the transverse direction. Some sets of press rolls have speed differences to stretch the film in machine direction. Finally, the laminated XF film 1 has to be annealed with some sets of press rolls to release the internal stress built in the film during the stretching process. A regular blown film has weakness in either machine or transverse direction. Since the cross-laminated film 1 is laminated by at least two layers of films with opposite cutting angles, the film of one layer can cover the weakness of film of the other layer(s). Here the laminated film 1 is also processed to yield a strengthened undulating structure of convex and concave surfaces as described in U.S. Pat. No. 5,626,944. The film 1 is laminated and stretched in the transverse direction with rolls having small grooves. The undulating structure is not optional but the result of the lamination and stretching. The product 1 as shown on the right in FIG. 6 has two layers 32A, 32B with major directions of orientation which criss-cross each other, and which are at an angle with respect to the machine direction, i.e., the direction of travel of the film toward and into roll 36.

Returning now to description of film layer 22 (which has a machine direction oriented parallel to the film length) and the film layer 32 (which has been further processed to have a machine direction oriented transverse to the film length), which may correspond with either of the layers 32A, 32B of the drawstring film 1, the core component 4, 10 preferably constitutes between about 45% and about 90%, such as between about 55% and about 80% by weight of the respective layer. The core component 4, 10 contains a thermoplastic component and an elastic component. In one preferred embodiment, the core component 4, 10 comprises between about 50 and about 95 weight %, such as between about 70 and about 95 weight %, between about 80 weight % and about 90 weight %, or between about 70 and about 90 weight % of a thermoplastic component, and between about 5 weight % and about 40 weight %, such as between about 10 weight % and about 25 or 20 weight %, of an elastic component. The core component 4, 10 may optionally contain up to about 25 weight % cumulatively of additive components such as the above-described color and UV components.

The sealing component 6, 12 preferably constitutes between about 5 and about 30 or 40%, such as between about 10% and about 25 or 30% by weight of the respective layer 32A, 32B. The sealing component 6, 12 contains a thermoplastic component. In one preferred embodiment, the sealing component 6, 12 comprises between about 75 and about 95 or 100 weight %, such as between about 80 weight % and about 90 or 95 weight %, of a thermoplastic component and up to about 25 weight % cumulatively of additive components such as the above-described color and UV components.

The laminating component 2, 8 preferably constitutes between about 5 and about 20 or 25% by weight, such as between about 5 and about 15 or 20 weight %, of the respective layer 32A, 32B. The laminating component 2, 8 contains a thermoplastic component including m-LLDPE, such as Affinity, Exact, etc. In one preferred embodiment, the laminating component 2, 8 comprises between about 90 or 95 and about 100 weight % of a thermoplastic component with about 10-90% m-LLDPE and up to about 5 or 10 weight % cumulatively of additive components such as the above-described antiblock component. The components in the formula are weighed and mixed and then transported to the hoppers of the extruders.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

What is claimed is:

1. A plastic can liner comprising:

first and second plastic panels joined along edges of the panels;

a can liner opening defined by opposed first and second panel edges which are not joined;

a first hem along the first panel edge defining the can liner opening and a second hem along the second panel edge defining the can liner opening; and a drawstring running through the first and second hems, wherein the drawstring is a cross-laminated plastic film;

wherein the cross-laminated plastic film comprises at least a first layer and a second layer bonded to each other and each comprising a thermoplastic component; and an elastic polymer component in at least one of said first and second layers.

2. The plastic can liner of claim 1 wherein both the first layer and the second layer each have an elastic polymer component and a thermoplastic component.

3. The plastic can liner of claim 1 wherein the first and second layers are co-extruded layers each comprising at least three plies.

4. The plastic can liner of claim 1 wherein the drawstring has a seal line which is offset from perpendicular to the length of the drawstring by at least 5°, such as between about 5° and about 30°.

5. The plastic can liner of claim 1 wherein the drawstring has lengthwise ridges.

6. The plastic can liner of claim 5 wherein the drawstring has lengthwise ridges on both its outwardly and inwardly facing surfaces.

7. The plastic can liner of claim 6 wherein the ridges on the outwardly facing surfaces are deeper than the ridges on the inwardly facing surfaces.

8. The plastic can liner of claim 1 wherein the drawstring comprises a first drawstring strip and a second drawstring strip sealed together along seals adjacent opposite ends thereof.

9. The plastic can liner of claim 8 wherein the seals are oriented transverse to the length of the drawstring strips and angle outward toward the first and second panel edges.

10. The plastic can liner of claim 8 wherein the seals join the drawstring to the first and second panels.

11. A plastic can liner comprising:

first and second plastic panels joined along edges of the panels;

a can liner opening defined by opposed first and second panel edges which are not jointed;

a first hem along the first panel edge defining the can liner opening and a second hem along the second panel edge defining the can liner opening; and a drawstring running through the first and second hems, wherein the drawstring is a cross-laminated plastic film and has lengthwise ridges; and wherein the drawstring has a weight per unit area of from about 60 gsm to about 90 gsm and has tensile strength in MD of at least about 10 lbf/in.

12. A plastic can liner comprising:

first and second plastic panels joined along edges of the panels;

a can liner opening defined by opposed first and second panel edges which are not joined;

a first hem along the first panel edge defining the can liner opening and a second hem along the second panel edge defining the can liner opening; and a drawstring running through the first and second hems, wherein the drawstring is a cross-laminated plastic film and has lengthwise ridges; and wherein the drawstring has a weight per unit area of about 100 gsm and has tear strength in both MD and TD greater than about 3,000 grams.

13. A plastic can liner comprising:

first and second plastic panels joined along edges of the panels;

a can liner opening defined by opposed first and second panel edges which are not joined;

a first hem along the first panel edge defining the can liner opening and a second hem along the second panel edge defining the can liner opening; and a drawstring running through the first and second hems, wherein the drawstring is a cross-laminated plastic film and has lengthwise ridges; and wherein the drawstring has a weight per unit area of about 100 gsm and maintains at least 50% of the strength after 2 minutes with 5% of elongation.

14. A plastic can liner comprising:

first and second plastic panels joined along edges of the panels;

a can liner opening defined by opposed first and second panel edges which are not joined;

a first hem along the first panel edge defining the can liner opening and a second hem along the second panel edge defining the can liner opening; and a drawstring running through the first and second hems, wherein the drawstring is a cross-laminated plastic film;

wherein the drawstring comprises a first drawstring strip and a second drawstring strip sealed together along seals adjacent opposite ends thereof and wherein the seals join the drawstring to the first and second panels;

wherein the first and second panels comprise a tear line extending around each of the seals.

15. A drawstring for a plastic can liner comprising first and second drawstring strips, each of the first and second drawstring strips comprising a first end and a second end and a length extending from the first end to the second end, the drawstring comprising a first seal joining the first drawstring strip to the second drawstring strip adjacent the first ends thereof and a second seal joining the first drawstring strip to the second drawstring strip adjacent the second ends thereof to form a drawstring loop, the first drawstring strip being sized and shaped to be received in a first hem extending along a first panel edge of the can liner adjacent a first side of an opening of the can liner and the second drawstring strip being sized and shaped to be received in a second hem extending along a second panel edge of the can liner adjacent a second side of the opening, each of the first and second drawstring strips comprising a plastic film comprising a first layer and a second layer bonded to the first layer, each of the first and second layers having a machine direction oriented transverse to the length of the respective drawstring strip and the machine direction of the first layer being oriented transverse to the machine direction of the second layer;

wherein each of the first and second layers comprises a thermoplastic component and an elastic polymer component.

16. A drawstring for a plastic can liner comprising first and second drawstring strips, each of the first and second drawstring strips comprising a first end and a second end and a length extending from the first end to the second end, the drawstring comprising a first seal joining the first drawstring strip to the second drawstring strip adjacent the first ends thereof and a second seal joining the first drawstring strip to the second drawstring strip adjacent the second ends thereof to form a drawstring loop, the first drawstring strip being sized and shaped to be received in a first hem extending along a first panel edge of the can liner adjacent a first side of an opening of the can liner and the second drawstring strip being sized and shaped to be received in a second hem extending along a second panel edge of the can liner adjacent a second side of the opening, each of the first and second drawstring strips comprising a plastic film comprising a first layer and a second layer bonded to the first layer, each of the first and second layers having a machine direction oriented transverse to the length of the respective drawstring strip and the machine direction of the first layer being oriented transverse to the machine direction of the second layer;

wherein the first and second layers are co-extruded layers each comprising at least three plies.

17. A drawstring for a plastic can liner comprising first and second drawstring strips, each of the first and second drawstring strips comprising a first end and a second end and a length extending from the first end to the second end, the drawstring comprising a first seal joining the first drawstring strip to the second drawstring strip adjacent the first ends thereof and a second seal joining the first drawstring strip to the second drawstring strip adjacent the second ends thereof to form a drawstring loop, the first drawstring strip being sized and shaped to be received in a first hem extending along a first panel edge of the can liner adjacent a first side of an opening of the can liner and the second drawstring strip being sized and shaped to be received in a second hem extending along a second panel edge of the can liner adjacent a second side of the opening, each of the first and second drawstring strips comprising a plastic film comprising a first layer and a second layer bonded to the first layer, each of the first and second layers having a machine direction oriented transverse to the length of the respective drawstring strip and the machine direction of the first layer being oriented transverse to the machine direction of the second layer;

wherein the drawstring has a weight per unit area of about 100 gsm and has tear strength in the lengthwise direction and a direction perpendicular thereto greater than about 3,000 grams.

18. The drawstring of claim 17 wherein the drawstring of about 100 gsm maintains at least 50% of the strength after 2 minutes with 5% of elongation.

19. A plastic can liner comprising:

first and second plastic panels joined along edges of the panels;

a can liner opening defined by opposed first and second panel edges which are not joined;

a first hem along the first panel edge defining the can liner opening and a second hem along the second panel edge defining the can liner opening; and a drawstring running through the first and second hems, wherein the drawstring is a cross-laminated plastic film;

wherein:

the drawstring has lengthwise ridges on both its outwardly and inwardly facing surfaces;

the ridges on the outwardly facing surfaces are deeper than the ridges on the inwardly facing surfaces;

seals join the drawstring to the first and second panels; and the first and second panels comprise a tear line extending around each of the seals.

* * * * *